US009039450B2

(12) United States Patent
Germ et al.

(10) Patent No.: US 9,039,450 B2
(45) Date of Patent: May 26, 2015

(54) TERMINATION ARRANGEMENT FOR A CABLE BUNDLE

(71) Applicant: Delphi Technologies, Inc., Troy, MI (US)

(72) Inventors: Kenneth B. Germ, Niles, OH (US); James D. Daugherty, Brookfield, OH (US); Leslie L. Jones, Garrettsville, OH (US)

(73) Assignee: Delphi Technologies, Inc., Troy, MI (US)

( * ) Notice: Subject to any disclaimer, the term of this patent is extended or adjusted under 35 U.S.C. 154(b) by 188 days.

(21) Appl. No.: 13/741,838

(22) Filed: Jan. 15, 2013

(65) Prior Publication Data

US 2014/0199887 A1 Jul. 17, 2014

(51) Int. Cl.

| | |
|---|---|
| ***H01R 9/03*** | (2006.01) |
| ***H01R 13/52*** | (2006.01) |
| *H01R 13/512* | (2006.01) |
| *H01R 13/6592* | (2011.01) |
| *H01R 13/6596* | (2011.01) |

(52) U.S. Cl.

CPC ..... *H01R 9/032* (2013.01); *H01R 13/512* (2013.01); *H01R 13/5205* (2013.01); *H01R 13/6592* (2013.01); *H01R 13/6596* (2013.01)

(58) Field of Classification Search

CPC ..... H01R 13/658; H01R 13/65802; H01R 13/648; H01R 13/506; H01R 9/032

USPC ..... 439/607.41, 607.44, 607.52

See application file for complete search history.

(56) References Cited

U.S. PATENT DOCUMENTS

| | | | | |
|---|---|---|---|---|
| 3,603,912 | A * | 9/1971 | Kelly | 439/273 |
| 4,382,653 | A * | 5/1983 | Blanchard | 439/607.41 |
| 4,767,362 | A * | 8/1988 | Moji | 439/607.41 |
| 4,960,392 | A | 10/1990 | Dickie | |
| 4,963,104 | A | 10/1990 | Dickie | |
| 5,432,301 | A | 7/1995 | Gehring | |
| 5,691,506 | A * | 11/1997 | Miyazaki et al. | 174/652 |
| 5,707,253 | A * | 1/1998 | Matsumoto et al. | 439/607.5 |
| 5,917,153 | A | 6/1999 | Geroldinger | |
| 5,965,847 | A * | 10/1999 | Tanaka et al. | 174/84 R |
| 6,042,396 | A * | 3/2000 | Endo et al. | 439/98 |
| 6,270,377 | B1 * | 8/2001 | Miyazaki et al. | 439/607.41 |
| 6,355,888 | B2 | 3/2002 | Feketitsch | |
| 6,452,102 | B1 | 9/2002 | DeForest, Jr. et al. | |
| 6,528,727 | B2 * | 3/2003 | Miyazaki | 174/84 R |
| 6,595,789 | B2 * | 7/2003 | Oota et al. | 439/98 |
| 6,669,511 | B1 * | 12/2003 | Yagi et al. | 439/607.44 |

(Continued)

*Primary Examiner* — Abdullah Riyami
*Assistant Examiner* — Vladimir Imas
(74) *Attorney, Agent, or Firm* — Thomas N. Twomey

(57) ABSTRACT

A termination arrangement for a cable bundle includes a body with a cable cavity extending therethrough with the plurality of cables extending into the cable cavity. The body includes a cable attachment end through which the cable bundle enters the cable cavity. The cable attachment end includes an annular-shaped sealing recess radially surrounding a portion of the cable cavity. The sealing recess has an inner wall, an outer wall radially surrounding the inner wall, and a bottom wall joining the inner wall and the outer wall. An electromagnetic shield radially surrounds the cable bundle outside of the cavity and extends into the sealing recess. An insulation tubing radially surrounds the electromagnetic shield and the cable bundle outside of the cable cavity and extends into the sealing recess. A collar secured to the cable attachment end retains the electromagnetic shield and the insulation tubing within the sealing recess.

16 Claims, 3 Drawing Sheets

(56) References Cited

U.S. PATENT DOCUMENTS

| | | | | |
|---|---|---|---|---|
| 6,688,896 | B2 * | 2/2004 | Matsumoto | 439/98 |
| 6,887,106 | B2 * | 5/2005 | Noguchi et al. | 439/607.56 |
| 6,916,203 | B2 * | 7/2005 | Oyamada et al. | 439/587 |
| 7,038,134 | B2 * | 5/2006 | Daugherty et al. | 174/75 C |
| 7,044,756 | B1 * | 5/2006 | Asakura et al. | 439/98 |
| 7,165,995 | B2 * | 1/2007 | Fukushima et al. | 439/607.58 |
| 7,275,960 | B2 * | 10/2007 | Fukushima et al. | 439/607.15 |
| 7,306,479 | B1 * | 12/2007 | Wu | 439/497 |
| 7,314,998 | B2 * | 1/2008 | Amato et al. | 174/84 R |
| 7,344,413 | B2 * | 3/2008 | Nishida | 439/607.41 |
| 7,476,129 | B2 * | 1/2009 | Droesbeke et al. | 439/607.41 |
| 7,491,071 | B2 * | 2/2009 | Hamai et al. | 439/98 |
| 7,530,848 | B2 * | 5/2009 | Nagashima et al. | 439/607.41 |
| 7,534,138 | B1 * | 5/2009 | Gump et al. | 439/564 |
| 7,614,910 | B2 * | 11/2009 | Croteau et al. | 439/573 |
| 7,632,148 | B1 * | 12/2009 | Kawamura et al. | 439/607.41 |
| 7,666,032 | B2 * | 2/2010 | Aoki et al. | 439/607.41 |
| 7,726,985 | B2 * | 6/2010 | Gladd et al. | 439/98 |
| 7,727,020 | B2 * | 6/2010 | Gladd et al. | 439/607.41 |
| 7,727,021 | B2 * | 6/2010 | Haruna et al. | 439/607.5 |
| 7,731,536 | B2 * | 6/2010 | Okayasu | 439/607.51 |
| 7,735,876 | B2 * | 6/2010 | Chiu | 285/207 |
| 7,749,025 | B2 * | 7/2010 | Aoki et al. | 439/607.41 |
| 7,900,971 | B2 * | 3/2011 | Chiu | 285/207 |
| 8,167,653 | B2 * | 5/2012 | Hasegawa et al. | 439/607.41 |
| 8,342,880 | B2 * | 1/2013 | Kato et al. | 439/595 |
| 8,408,943 | B2 * | 4/2013 | Okamoto | 439/607.55 |
| 8,540,531 | B2 * | 9/2013 | Harris | 439/587 |
| 8,602,797 | B2 * | 12/2013 | Omae | 439/99 |
| 8,790,135 | B2 * | 7/2014 | Maegawa | 439/587 |
| 8,790,137 | B2 * | 7/2014 | Deno et al. | 439/607.41 |
| 8,808,012 | B2 * | 8/2014 | Omae et al. | 439/98 |
| 2005/0130496 | A1 | 6/2005 | Ko | |
| 2010/0062631 | A1 * | 3/2010 | Gladd et al. | 439/271 |
| 2011/0086548 | A1 | 4/2011 | Wu | |
| 2012/0190238 | A1 * | 7/2012 | Omae | 439/620.01 |
| 2012/0196467 | A1 * | 8/2012 | Liptak et al. | 439/345 |
| 2013/0084728 | A1 * | 4/2013 | Omae et al. | 439/271 |

* cited by examiner

TERMINATION ARRANGEMENT FOR A CABLE BUNDLE

TECHNICAL FIELD OF INVENTION

The present invention relates to a cable bundle; more particularly to a cable bundle radially surrounded by an electromagnetic shield and an insulation tubing; even more particularly to a termination arrangement for a cable bundle surrounded by an electromagnetic shield and an insulation tubing, and still even more particularly to a termination arrangement for sealing and grounding a cable bundle surrounded by an electromagnetic shield and an insulation tubing.

BACKGROUND OF INVENTION

A cable bundle for transmitting electrical currents and/or signals from a first device to a second device may be surrounded by an electromagnetic shield. In addition to the electromagnetic shield, an insulation tubing may surround both the electromagnetic shield and the cable bundle. U.S. Pat. No. 5,432,301 to Gehring shows a termination arrangement for such a cable bundle surrounded by an electromagnetic shield and an insulation tubing. The termination arrangement of Gehring includes passing the cable bundle through a clamping collar. A clamping element is provided around the tubing insulation and the electromagnetic shield is folded backward over a portion of the clamping element. The portion of the clamping element with the folded back portion of the electromagnetic shield is positioned within the clamping collar where it is pressed tightly therein with a backing collar. In this way, the electromagnetic shield is grounded to the clamping collar. While this arrangement may provide an adequate ground connection between the electromagnetic shield and the clamping element, foreign matter, in particular liquids, may be able to enter the clamping element through the interface of the clamping element and the electromagnetic shield. Foreign matter entering the clamping element may be undesirable in many applications.

Another known termination arrangement uses a crimped ring to attach the electromagnetic shield to a body around which the end of the electromagnetic shield is placed. Using a crimped ring to attach the electromagnetic shield to the body may make sealing of the termination arrangement difficult which may lead to foreign matter, in particular liquid, entering the body.

What is needed is a termination arrangement for a cable bundle which minimizes or eliminates one or more of the shortcomings as set forth above.

SUMMARY OF THE INVENTION

Briefly described, a termination arrangement is provided for a cable bundle. The termination arrangement includes a body with a cable cavity extending therethrough with the plurality of cables extending into the cable cavity. The body includes a cable attachment end through which the cable bundle enters the cable cavity. The cable attachment end includes an annular-shaped sealing recess concentric about an axis and radially surrounding a portion of the cable cavity. The sealing recess has an inner wall, an outer wall radially surrounding the inner wall, and a bottom wall joining the inner wall and the outer wall. An electromagnetic shield radially surrounds the cable bundle outside of the cavity and extends into the sealing recess. An insulation tubing radially surrounds the electromagnetic shield and the cable bundle outside of the cable cavity and extends into the sealing recess. A collar secured to the cable attachment end retains the electromagnetic shield and the insulation tubing within the sealing recess.

BRIEF DESCRIPTION OF DRAWINGS

This invention will be further described with reference to the accompanying drawings in which.

DETAILED DESCRIPTION OF INVENTION

Figure 1:
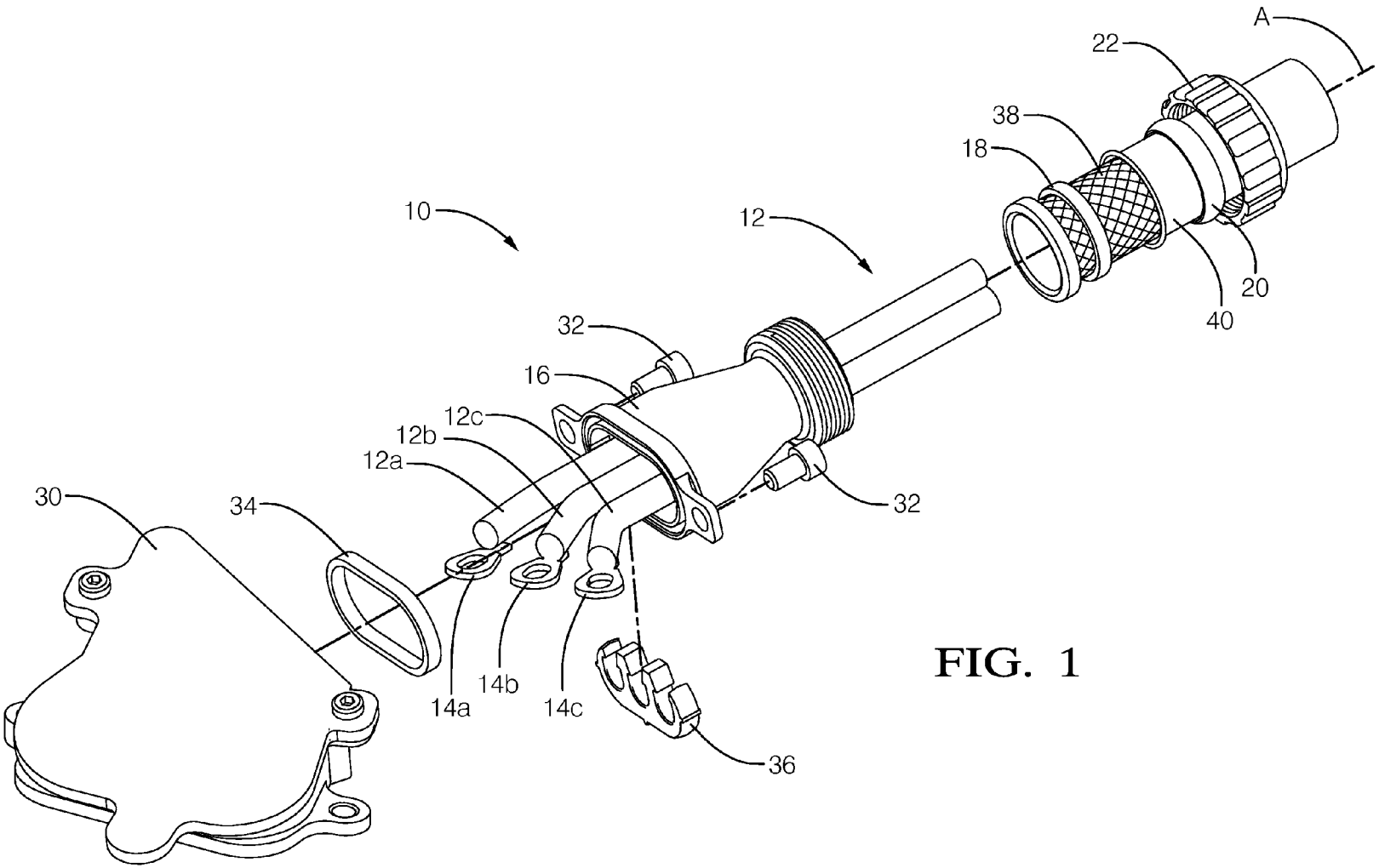
FIG. 1 is an isometric exploded view of a termination arrangement for a cable bundle in accordance the present invention.
Figure 2:
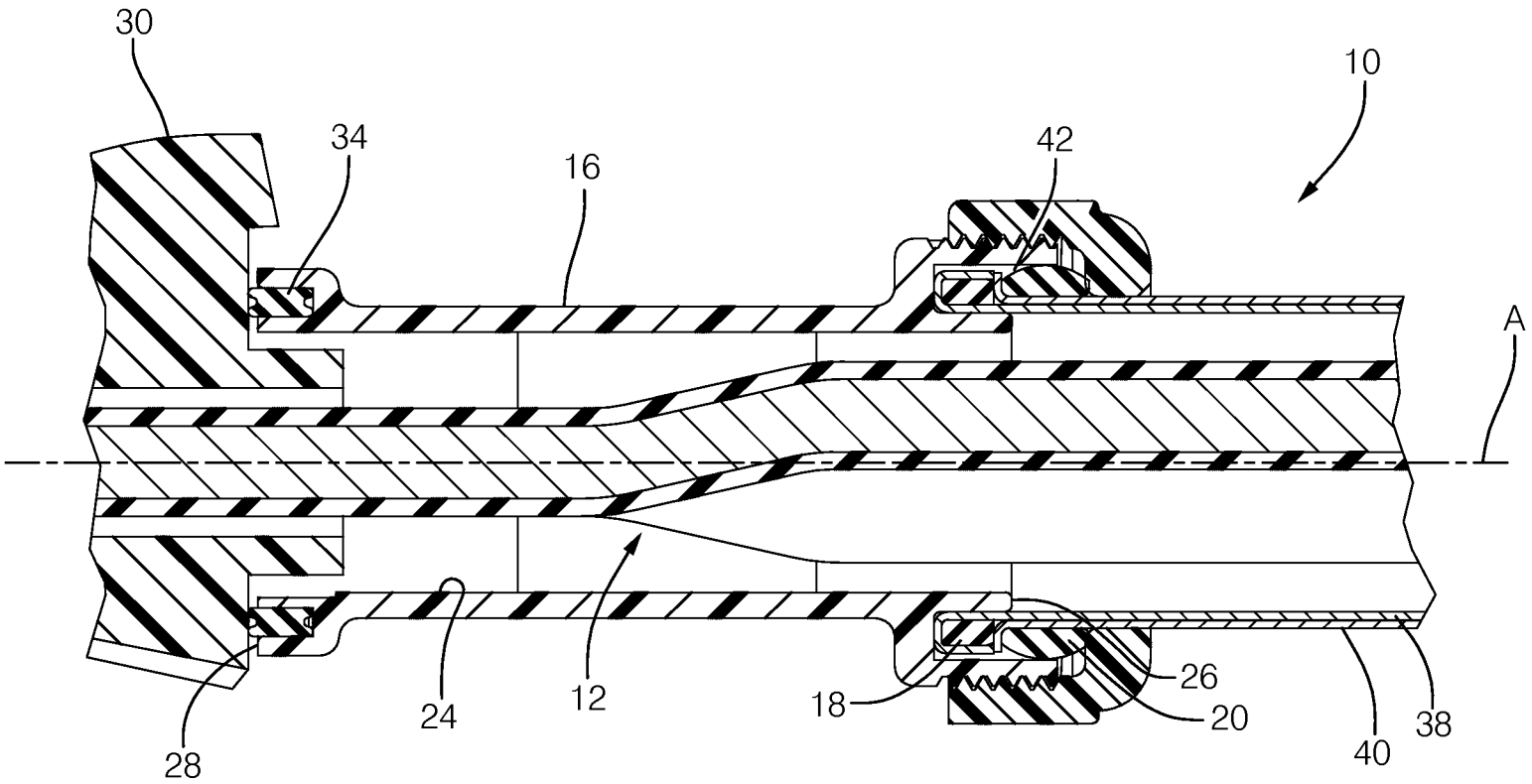
FIG. 2 is a cross-sectional view of the termination arrangement of FIG. 1.
Figure 3:
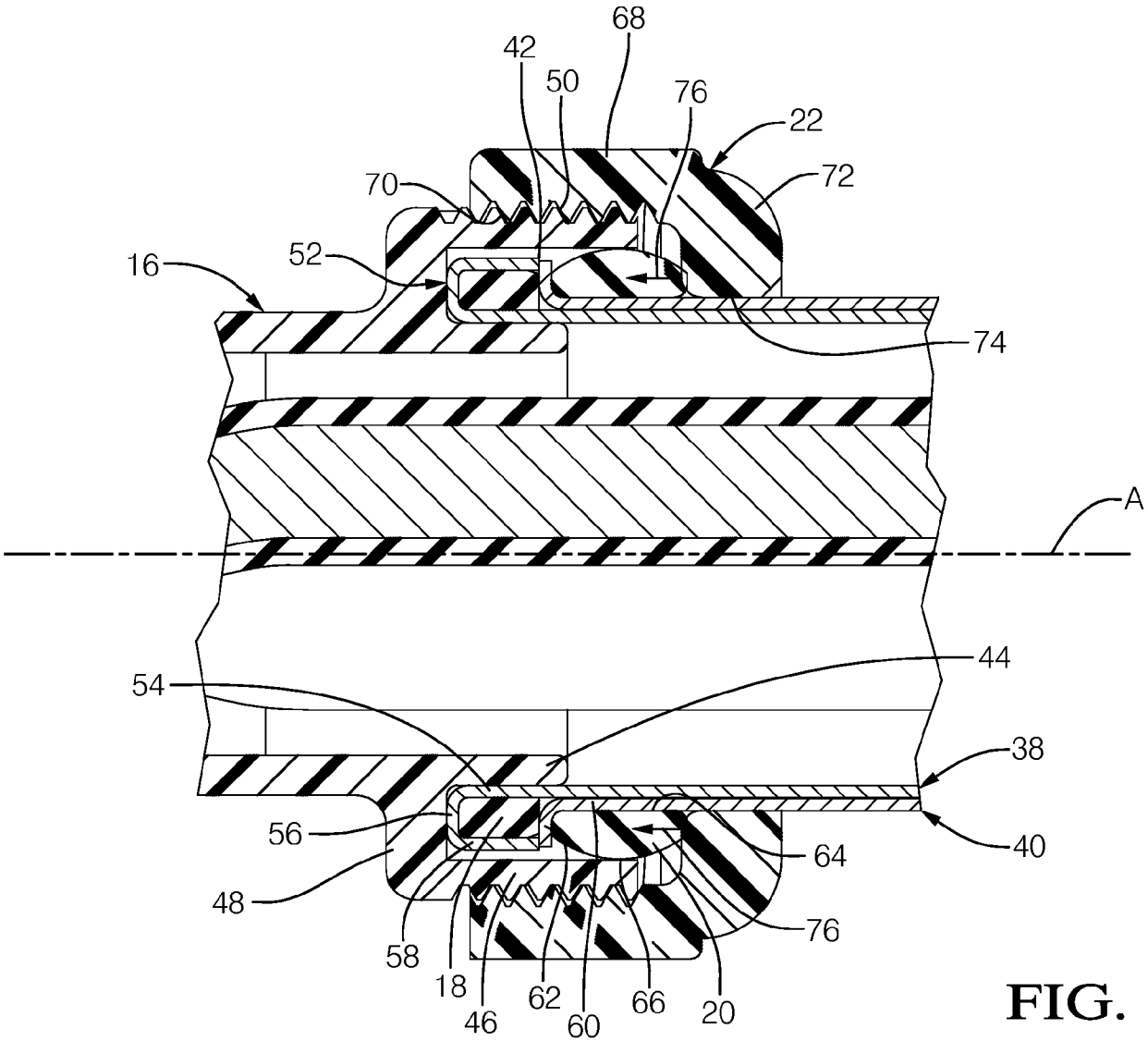
FIG. 3 is an enlarged view of a portion of the cross-sectional view of FIG. 2.

Referring now to FIGS. 1-3 wherein like reference numerals are used to identify identical components in the various views, a termination arrangement 10 is shown for terminating a cable bundle 12 which transmits electric currents or signals from a first device (not shown) to a second device (not shown). As shown in FIG. 1, cable bundle 12 includes three cables 12*a*, 12*b*, 12*c*; however, it should be understood that any number of cables may be provided. Each cable 12*a*, 12*b*, 12*c* includes an electrically conductive core covered with a wire insulation. The electrically conductive core of each cable 12*a*, 12*b*, 12*c* is in electrical communication with a respective cable terminal 14*a*, 14*b*, 14*c* for connection to a mating terminal (not shown). Termination arrangement 10 generally includes a body 16, a shield ferrule 18, an insulation tubing ferrule 20, and a collar 22.

Body 16 may be made of an electrically conductive material, for example aluminum, and includes a cable cavity 24 extending through body 16 from a cable attachment end 26 to a case attachment end 28. Case attachment end 28 may be configured to be attached to a case 30, for example by screws 32. Seal 34 may be provided between body 16 and case 30 in order to prevent foreign matter from entering case 30 and body 16 through the interface between case 30 and body 16.

A cable separator 36 may be positioned closely within a portion of cable cavity 24 that is proximal to case attachment end 28. Cable separator 36 segregates each cable 12*a*, 12*b*, 12*c* from the others and neatly positions each cable 12*a*, 12*b*, 12*c* to aid in attachment of each cable terminal 14*a*, 14*b*, 14*c* to its respective mating terminal. Cable separator 36 also positions cables 12*a*, 12*b*, 12*c*, away from body 16 in order to prevent the wire insulation from abrading against body 16 in use.

Cable bundle 12 extends into and through cable cavity 24 of body 16 as shown in the figures. The portion of cable bundle 12 that extends outward of cable cavity 24 away from cable attachment end 26 of body 16 is radially surrounded by an electromagnetic shield 38. Electromagnetic shield 38 may be a flexible metallic mesh in order to allow cable bundle 12 to flex. The portion of cable bundle 12 that extends outward of cable cavity 24 away from cable attachment end 26 of body 16 is also radially surrounded by an insulation tubing 40 which also radially surrounds electromagnetic shield 38. Insulation tubing 40 is a protective barrier to electromagnetic shield 38 and cable bundle 12 and is flexible and electrically insulative. It should be noted that the exploded view of FIG. 1 shows shield ferrule 18, insulation tubing ferrule 20, collar 22, electromagnetic shield 38 and insulation tubing 40 moved with respect to their assembled positions although not entirely exploded from each other.

Features of termination arrangement 10 that are used to attach and ground electromagnetic shield 38 to body 16 and to attach and seal insulation tubing 40 to body 16 will now be described in the paragraphs that follow.

Cable attachment end 26 of body 16 includes an annular-shaped sealing recess 42 which is centered about an axis A and which generally follows the same direction along which cable bundle 12 passes through cable cavity 24. Sealing recess 42 radially surrounds a portion of cable cavity 24 and is defined by a generally cylindrical inner wall 44 centered about axis A, a generally cylindrical outer wall 46 that coaxially surrounds inner wall 44, and a bottom wall 48 which joins inner wall 44 and outer wall 46 at the end of sealing recess 42 that is proximal to case attachment end 28. Bottom wall 48 extends radially outward from inner wall 44 and is generally perpendicular to both inner wall 44 and outer wall 46. An outside surface of outer wall 46 includes external threads 50 for engaging collar 22 as will be described in more detail later.

In order to ground electromagnetic shield 38 to body 16, the end of electromagnetic shield 38 extends into sealing recess 42. The end of electromagnetic shield 38 that extends into sealing recess 42 is formed with a convolute 52 such that the end of electromagnetic shield 38 extending into sealing recess 42 includes a shield main portion 54 that is positioned parallel to the outer perimeter of inner wall 44, a shield end portion 56 that is positioned parallel to and in direct contact with bottom wall 48, and a shield concentric portion 58 radially surrounding shield main portion 54. Shield main portion 54 may be positioned in direct contact with the outer perimeter of inner wall 44 and shield concentric portion 58 may be positioned in direct contact with the inner perimeter of outer wall 46.

Shield ferrule 18 is ring-shaped and positioned within convolute 52 of electromagnetic shield 38. In this way, shield ferrule 18 radially surrounds shield main portion 54, shield end portion 56 is captured axially between shield ferrule 18 and bottom wall 48, and shield concentric portion 58 radially surrounds shield ferrule 18. As will be described in greater detail later, an axial force is applied to shield ferrule 18 to ensure a good ground connection is made between electromagnetic shield 38 and body 16.

In order to secure insulation tubing 40 to body 16, the end of insulation tubing 40 extends into sealing recess 42. The end of insulation tubing 40 that extends into sealing recess 42 includes a tubing main portion 60 positioned parallel to electromagnetic shield 38 and a tubing end portion 62 that extends radially outward from tubing main portion 60 and is in direct contact with shield ferrule 18. Tubing end portion 62 is substantially perpendicular to inner wall 44 and is used to retain insulation tubing 40 to body 16 by application of an axial force to tubing end portion 62 as will be described in greater detail later.

Insulation tubing ferrule 20 is ring-shaped and positioned at least partly within sealing recess 42. Insulation tubing ferrule 20 radially surrounds tubing main portion 60 and captures tubing end portion 62 axially between insulation tubing ferrule 20 and shield ferrule 18. An insulation tubing ferrule inner circumference 64 is in sealing contact with tubing main portion 60 while an insulation tubing ferrule outer circumference 66 is in sealing contact with the inner perimeter of outer wall 46. In this way, insulation tubing ferrule 20 radially seals against insulation tubing 40 and outer wall 46 to prevent foreign matter from entering cable cavity 24 through sealing recess 42. As will be described in greater detail later, an axial force is applied to insulation tubing ferrule 20 to retain insulation tubing 40 to body 16.

Collar 22 includes a collar annular wall 68 centered about and substantially parallel to axis A. Collar annular wall 68 includes internal threads 70 on an inside surface thereof which threadably engage external threads 50 of body 16. Collar 22 also includes a collar flange 72 extending radially inward from collar annular wall 68. Collar flange 72 includes collar aperture 74 extending therethrough to allow cable bundle 12, electromagnetic shield 38, and insulation tubing 40 to pass through collar aperture 74. Collar aperture 74 is sized sufficiently large to allow cable bundle 12, electromagnetic shield 38, and insulation tubing 40 to pass therethrough and sufficiently small such that collar flange 72 can apply an axial force, represented by arrows 76, to insulation tubing ferrule 20. In this way, insulation tubing ferrule 20 is captured axially between tubing end portion 62 and collar flange 72.

When collar 22 is tightened to body 16, using internal threads 70 and external threads 50, collar 22 applies axial force 76 to insulation tubing ferrule 20. Axial force 76 is transmitted through insulation tubing ferrule 20, tubing end portion 62, shield ferrule 18, and shield end portion 56 to bottom wall 48 of sealing recess 42. In this way, insulation tubing ferrule 20, tubing end portion 62, shield ferrule 18, and shield end portion 56 are clamped securely between collar flange 72 and bottom wall 48 of sealing recess 42. Axial force 76 provides a secure attachment of electromagnetic shield 38 and insulation tubing 40 to body 16. Axial force 76 may also cause insulation tubing ferrule 20 to expand radially inward and/or radially outward to thereby positively seal insulation tubing ferrule 20 with insulation tubing 40 and inner wall 44.

While this invention has been described in terms of preferred embodiments thereof, it is not intended to be so limited, but rather only to the extent set forth in the claims that follow.

We claim:

1. A termination arrangement for a cable bundle, said termination arrangement comprising:

a body with a cable cavity extending therethrough with said cable bundle extending into said cable cavity, said body including a cable attachment end through which said cable bundle enters said cable cavity, said cable attachment end having an annular-shaped sealing recess concentric about an axis and radially surrounding a portion of said cable cavity, said sealing recess having an inner wall, an outer wall radially surrounding said inner wall, and a bottom wall joining said inner wall and said outer wall;

an electromagnetic shield radially surrounding said cable bundle outside of said cable cavity, said electromagnetic shield extending into said sealing recess;

an insulation tubing radially surrounding said electromagnetic shield and said cable bundle outside of said cable cavity, said insulation tubing extending into said sealing recess; and a collar secured to said cable attachment end which retains said electromagnetic shield and said insulation tubing within said sealing recess.

2. A termination arrangement as in claim 1, further comprising a shield ferrule disposed within said sealing recess, wherein a main portion of said electromagnetic shield is radially surrounded by said shield ferrule and wherein an end portion of said electromagnetic shield is captured axially between said shield ferrule and said bottom wall of said sealing recess.

3. A termination arrangement as in claim 2, wherein a concentric portion of said electromagnetic shield radially surrounds said shield ferrule.

4. A termination arrangement as in claim 2, further comprising an insulation tubing ferrule disposed within said sealing recess, wherein a main portion of said insulation tubing is radially surrounded by said insulation tubing ferrule and wherein an end portion of said insulation tubing is captured axially between said shield ferrule and said insulation tubing ferrule.

5. A termination arrangement as in claim 4, wherein:

said insulation tubing ferrule radially seals against said insulation tubing and said outer wall to prevent foreign matter from entering said cable cavity through said sealing recess.

6. A termination arrangement as in claim 4, wherein said insulation tubing ferrule is captured axially between said end portion of said insulation tubing and said collar.

7. A termination arrangement as in claim 6, wherein:

said outer wall includes external threads thereon; and said collar includes internal threads that threadably engage said external threads.

8. A termination arrangement as in claim 7, wherein:

said collar includes an annular wall radially surrounding said outer wall; and said collar includes a flange extending radially inward from said annular wall, said flange having an aperture with said cable bundle, said electromagnetic shield, and said insulation tubing extending therethrough.

9. A termination arrangement as in claim 8 wherein said flange of said collar provides an axial force to said electromagnetic shield, said shield ferrule, said insulation tubing, and said insulation tubing ferrule, thereby clamping said electromagnetic shield, said shield ferrule, said insulation tubing, and said insulation tubing ferrule between said flange of said collar and said bottom wall of said body.

10. A termination arrangement as in claim 2, further comprising an insulation tubing ferrule disposed within said sealing recess, wherein a main portion of said insulation tubing is radially surrounded by said insulation tubing ferrule and wherein an end portion of said insulation tubing is captured axially between said shield ferrule and said insulation tubing ferrule.

11. A termination arrangement as in claim 10, wherein:

said insulation tubing ferrule radially seals against said insulation tubing and said outer wall to prevent foreign matter from entering said cable cavity through said sealing recess.

12. A termination arrangement as in claim 10, wherein said insulation tubing ferrule is captured axially between said end portion of said insulation tubing and said collar.

13. A termination arrangement as in claim 12, wherein:

said outer wall includes external threads thereon; and said collar includes internal threads that threadably engage said external threads.

14. A termination arrangement as in claim 13, wherein:

said collar includes an annular wall radially surrounding said outer wall; and said collar includes a flange extending radially inward from said annular wall, said flange having an aperture with said cable bundle, said electromagnetic shield, and said insulation tubing extending therethrough.

15. A termination arrangement as in claim 14 wherein said flange of said collar provides an axial force to said electromagnetic shield, said insulation tubing, and said insulation tubing ferrule, thereby clamping said electromagnetic shield, said insulation tubing, and said insulation tubing ferrule between said flange of said collar and said bottom wall of said body.

16. A termination arrangement for a cable bundle, said termination arrangement comprising:

a body with a cable cavity extending therethrough with said cable bundle extending into said cable cavity, said body including a cable attachment end through which said cable bundle enters said cable cavity, said cable attachment end having an annular-shaped sealing recess concentric about an axis and radially surrounding a portion of said cable cavity, said sealing recess having an inner wall, an outer wall radially surrounding said inner wall, and a bottom wall joining said inner wall and said outer wall;

an electromagnetic shield radially surrounding said cable bundle outside of said cable cavity, said electromagnetic shield extending into said sealing recess;

an insulation tubing radially surrounding said electromagnetic shield and said cable bundle outside of said cable cavity, said insulation tubing extending into said sealing recess;

a shield ferrule disposed within said sealing recess, wherein a main portion of said electromagnetic shield is radially surrounded by said shield ferrule and wherein an end portion of said electromagnetic shield is captured axially between said shield ferrule and said bottom wall of said sealing recess;

an insulation tubing ferrule disposed within said sealing recess, wherein a main portion of said insulation tubing is radially surrounded by said insulation tubing ferrule and wherein an end portion of said insulation tubing is captured axially between said shield ferrule and said insulation tubing ferrule; and a collar secured to said cable attachment end and providing an axial force to said electromagnetic shield, said shield ferrule, said insulation tubing, and said insulation tubing ferrule, thereby clamping said electromagnetic shield, said shield ferrule, said insulation tubing, and said insulation tubing ferrule between said collar and said bottom wall of said body.

* * * * *